US010612865B2

(12) United States Patent
Shin et al.

(10) Patent No.: US 10,612,865 B2
(45) Date of Patent: Apr. 7, 2020

(54) HEADER TANK OF HEAT EXCHANGER AND HEAT EXCHANGER HAVING THE SAME

(71) Applicant: Hanon Systems, Daejeon (KR)

(72) Inventors: Sung Hong Shin, Daejeon (KR); Hyun Woo Cho, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 73 days.

(21) Appl. No.: 15/044,151

(22) Filed: Feb. 16, 2016

(65) Prior Publication Data

US 2016/0238326 A1 Aug. 18, 2016

(30) Foreign Application Priority Data

Feb. 16, 2015 (KR) ..... 10-2015-0023368
Jan. 25, 2016 (KR) ..... 10-2016-0008528

(51) Int. Cl.
*F28F 9/02* (2006.01)
*F28D 1/053* (2006.01)

(52) U.S. Cl.
CPC ..... *F28F 9/0212* (2013.01); *F28D 1/05366* (2013.01); *F28F 9/0224* (2013.01)

(58) Field of Classification Search
CPC ..... F28D 1/05366; F28F 9/02; F28F 9/0212; F28F 9/0224; B21D 53/04; B23P 15/26
See application file for complete search history.

(56) References Cited

U.S. PATENT DOCUMENTS 5,036,914 A * 8/1991 Nishishita ..... F28F 9/0224 165/153
5,205,349 A * 4/1993 Nagao ..... B60H 1/00328 165/153
5,209,292 A * 5/1993 Arneson ..... F28F 9/0212 165/174
5,390,519 A * 2/1995 Kuroda ..... F28F 9/0224 29/890.052
5,727,626 A * 3/1998 Kato ..... F28F 9/0224 165/153

(Continued)

FOREIGN PATENT DOCUMENTS

CN 104334999 A 2/2015
JP 2010121794 A 6/2010

(Continued)

OTHER PUBLICATIONS

Machine Translation of KR 2002-0045047, retrieved Jun. 19, 2019 (Year: 2019).*

*Primary Examiner* — Eric S Ruppert
*Assistant Examiner* — Hans R Weiland
(74) *Attorney, Agent, or Firm* — Shumaker, Loop & Kendrick, LLP; James D. Miller

(57) ABSTRACT

The header tank of the heat exchanger and the heat exchanger having the same may prevent leakage of a heat exchanging medium from the header tank of the heat exchanger after a header, a tank, and a baffle are bonded by a brazing by forming concavely forming parts at an outer side of the header so that edge portions of the header at which the header, the tank, and the baffle are joined together with one another are not spaced apart from the tank and the baffle to minimize a gap (space) of portions at which inner side edge portions of the header are joined with the tank and the baffle.

12 Claims, 10 Drawing Sheets

(56) References Cited

U.S. PATENT DOCUMENTS

| | | | | | |
|---|---|---|---|---|---|
| 5,816,316 | A * | 10/1998 | Hoffnung | F28F 9/0224 | 165/76 |
| 5,816,321 | A * | 10/1998 | Wijkstrom | F28F 9/0224 | 165/173 |
| 6,053,243 | A * | 4/2000 | Kato | F28F 9/0212 | 165/153 |
| 6,062,303 | A * | 5/2000 | Ahn | F28F 9/0224 | 165/110 |
| 6,216,776 | B1 * | 4/2001 | Kobayashi | F28F 9/0224 | 165/110 |
| 6,745,827 | B2 * | 6/2004 | Lee | F28F 9/0224 | 165/144 |
| 6,877,224 | B2 * | 4/2005 | Nitta | F28F 9/0202 | 29/727 |
| 2009/0095458 | A1 * | 4/2009 | Lim | F28F 9/0224 | 165/174 |
| 2013/0333867 | A1 * | 12/2013 | Moreau | F28F 9/0224 | 165/164 |
| 2015/0267971 | A1 * | 9/2015 | Sannohe | F28F 9/0224 | 165/181 |
| 2015/0267972 | A1 * | 9/2015 | Sannohe | F28F 9/0224 | 165/181 |

FOREIGN PATENT DOCUMENTS

| | | | |
|---|---|---|---|
| KR | 20020045047 | A * | 6/2002 |
| KR | 1020070081347 | A | 8/2007 |

* cited by examiner

HEADER TANK OF HEAT EXCHANGER AND HEAT EXCHANGER HAVING THE SAME

CROSS-REFERENCE TO RELATED APPLICATIONS

This patent application claims priority under 35 U.S.C. § 119 to Korean Patent Application No. 10-2015-0023368 filed on Feb. 16, 2015 and Korean Patent Application No. 10-2016-0008528 filed on Jan. 25, 2016 in the Korean Intellectual Property Office, the disclosure of each of which is hereby incorporated herein by reference in its entirety.

FIELD OF THE INVENTION

The following disclosure relates to a header tank of a heat exchanger and a heat exchanger having the same. More particularly the disclosure relates to a header tank of a heat exchanger capable of preventing leakage of a heat exchanging medium from the header tank of the heat exchanger after a header, a tank, and a baffle are bonded. The bonding may be by by brazing by allowing an edge portion of the header at which the header, the tank, and the baffle are joined together with one another not to be spaced apart from the tank and the baffle in the header tank to which the header and the tank are coupled to form a fluid path of the heat exchanging medium and to which the baffle interposed between the header and the tank and blocking a flow of the heat exchanging medium is coupled, and a heat exchanger having the same.

BACKGROUND OF THE INVENTION

A heat exchanger, which is an apparatus that absorbs heat from one side between two environments having a temperature difference and dissipates the absorbed heat to the other side, is operated as a cooling system when it absorbs inner heat and dissipates the absorbed heat to the outside, and is operated as a heating system when it absorbs outside heat and dissipates the absorbed heat to an inside.

FIGS. 1 to 3 are a perspective view, an exploded perspective view, and a schematic cross-sectional view illustrating a heat exchanger and a header tank according to the related art.

In general, the heat exchanger is configured to include a header 11 in which a plurality of tube insertion holes 11*a* arranged in a length direction of the header 11 is formed. A tank 12 is coupled to the header 11 to form a refrigerant fluid path in an inner space, and is configured to prevent leakage of a heat exchanging medium to the inside and the outside of a header tank 10 by a baffle 13 interposed and brazed between the header 11 and the tank 12.

Here, the header 11 having an end portion formed to be bent is configured so that an end portion of the tank 12 is seated on and coupled to an inner side of the end portion of the header 11, and the baffle 13 having an appearance formed to correspond to a shape of the inner space formed by the coupling of the header 11 and the tank 12 is coupled to the header 11. However, as illustrated in FIGS. 3 and 4, as a bent edge portion 11*b* of the end portion of the header 11 is formed in a round shape by a bending, an empty space is formed in a portion at which the header 11, the tank 12, and the baffle 13 are joined with one another. As a result, since a gap is not accurately filled at the time of brazing, there is a problem in that the heat exchanging medium is leaked through a bonded portion, thereby causing performance of the heat exchanger to be degraded. See also Korean Patent Document KR 2007-0081347 A (Date 2007 Aug. 16).

SUMMARY OF THE INVENTION

An embodiment of the present invention is directed to providing a header tank of a heat exchanger capable of preventing leakage of a heat exchanging medium from the header tank of the heat exchanger after a header, a tank, and a baffle are bonded by brazing. The leak avoidance is accomplished by allowing an edge portion of the header at which the header, the tank, and the baffle are joined together with one another not to be spaced apart from the tank and the baffle, in the header tank to which the header and the tank are coupled to form a fluid path of the heat exchanging medium and to which the baffle interposed between the header and the tank and blocking a flow of the heat exchanging medium is coupled, and a heat exchanger having the same.

In one general aspect, a header tank 100 of a heat exchanger includes a tank 200 formed to have a hollowed inside and an opened upper side; a header 300 disposed to be in contact with upper end surfaces 220 of both end portions 210 in a width direction of the tank 200 and coupled to the tank 200; and a baffle 400 interposed between the tank 200 and the header 300 and having an outer circumference surface formed to be in contact with inner circumference surfaces of the tank 200 and the header 300, wherein inner side edge portions 250 and 340 of the tank 200 and the header 300 at which the tank 200 and the header 300 are in contact with are formed to be in contact with an outer circumference surface of the baffle 400 while not form a space in portions at which the inner side edge portions 250 and 340 are in contact with the outer circumference surface of the baffle 400.

The inner side edge portion 250 of the end portions 210 of the tank 200 and the inner side edge portions 340 of the header 300 may not be rounded, but may be formed in an angled shape.

After the tank 200, the header 300, and the baffle 400 are assembled, the tank 200, the header 300, and the baffle 400 may be coupled to one another by welding or brazing.

The header 300 may include a bending part 310 formed to be upwardly convex; and bent parts 320 formed to have first or horizontal bent parts 321 formed by bending both ends of the bending part 310 in a width direction of the bending part 310 in an outer horizontal direction and second or vertical bent parts 322 formed to be downwardly bent from the horizontal bent parts 321 to thereby surround the upper end surfaces 220 and an outer side surface 240 of the end portions 210 of the tank 200, wherein the inner side edge portions 340 at which the bending part 310 and the horizontal bent parts 321 are joined with each other may be formed to be in contact with the upper end surfaces 220 of the tank 200 and the outer circumference surface of the baffle 400 while not forming a space in portions at which the inner side edge portions 340 are in contact with the upper end surfaces 220 of the tank 200 and the outer circumference surface of the baffle 400.

The header 300 may have the bending part 310 and the bent parts 320 formed by pressing or bending-machining a sheet of plate.

By a forming machining in which upper sides of end portions of the bending part 310 and upper sides of the horizontal bent parts 321 are pressed by upper jigs A in a state in which the header 300 is supported by lower jigs B so that inner sides of the end portions of the bending part 310 and lower sides of the horizontal bent parts 321 are supported, the edge portions 340 of the header 300 may be formed to be in contact with the tank 200 and the baffle 400 while not forming a space in portions at which the edge portions 340 are joined with the tank 200 and the baffle 400.

A portion of the bending part 310 and a portion of the horizontal bent parts 321 which are formed at both sides in relation to the edge portions 340 of the header 300 may be formed as forming parts 330 formed by pressing the portion of the bending part 310 and the portion of the horizontal bent parts 321 by the forming machining, and the forming parts 330 may be formed to have a thickness thinner than that of the remaining portions of the header 300.

The baffle 400 may have one or more protruding taps 420 formed to be extended from a circumference of a plate 410 formed in a disk shape, and tap insertion holes 260 and 312 may be formed in any one or more of the tank 200 and the header 300 so that the protruding taps 420 of the baffle 400 are inserted into and coupled to the tap insertion holes 260 and 312.

In another general aspect, a heat exchanger 1000 includes the header tanks 100 of the heat exchanger 1000 formed to be spaced apart from each other by a predetermined distance and be in a line; a plurality of tubes 500 having both ends connected to the header tanks 100; and pins 600 interposed between the tubes 500.

REFERENCE NUMERAL LISTING

Figure 1:
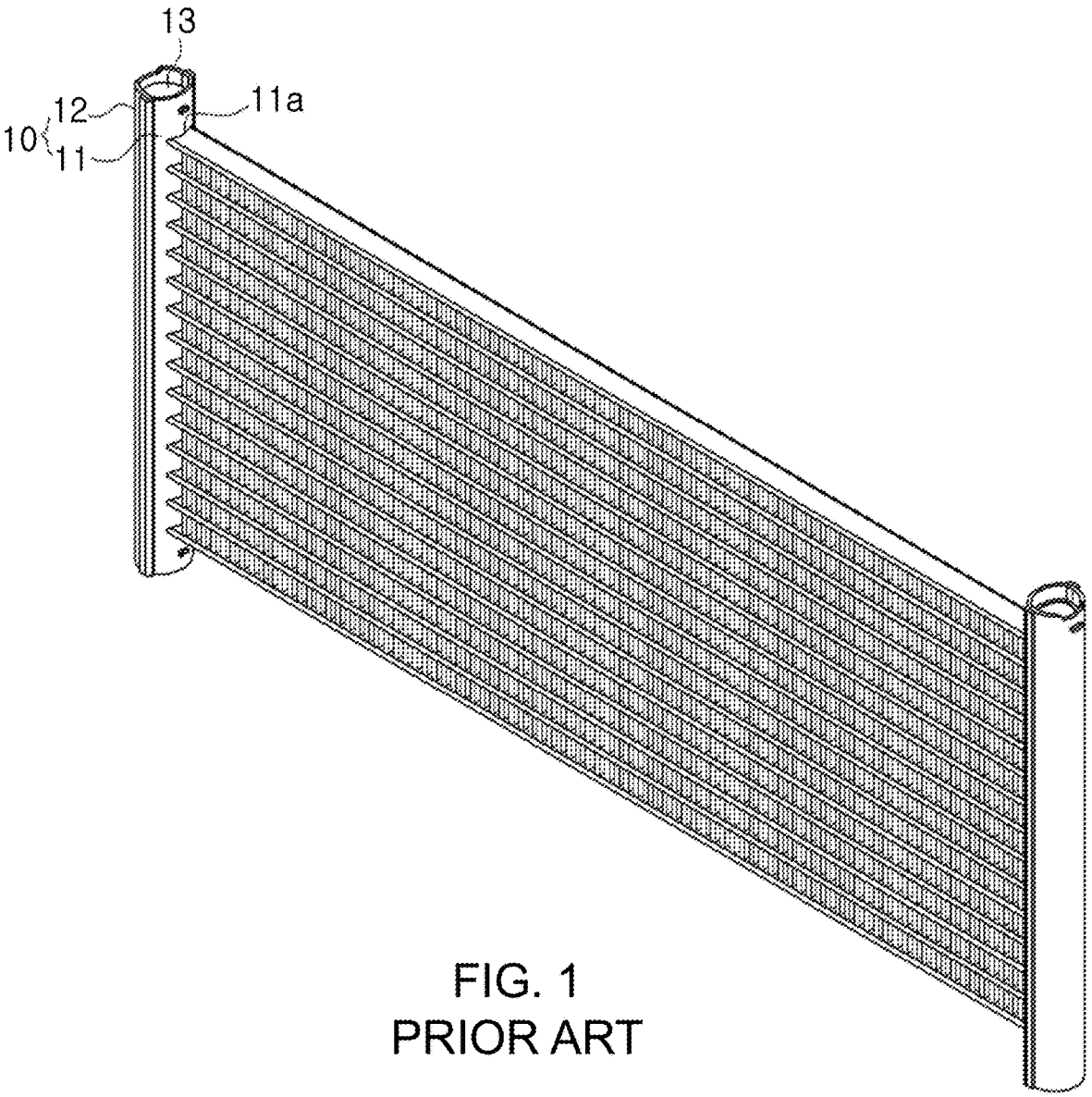
FIG. 1 PRIOR ART
FIG. 1 is a perspective view of a heat exchanger including header tanks according to the related art.
Figure 2:
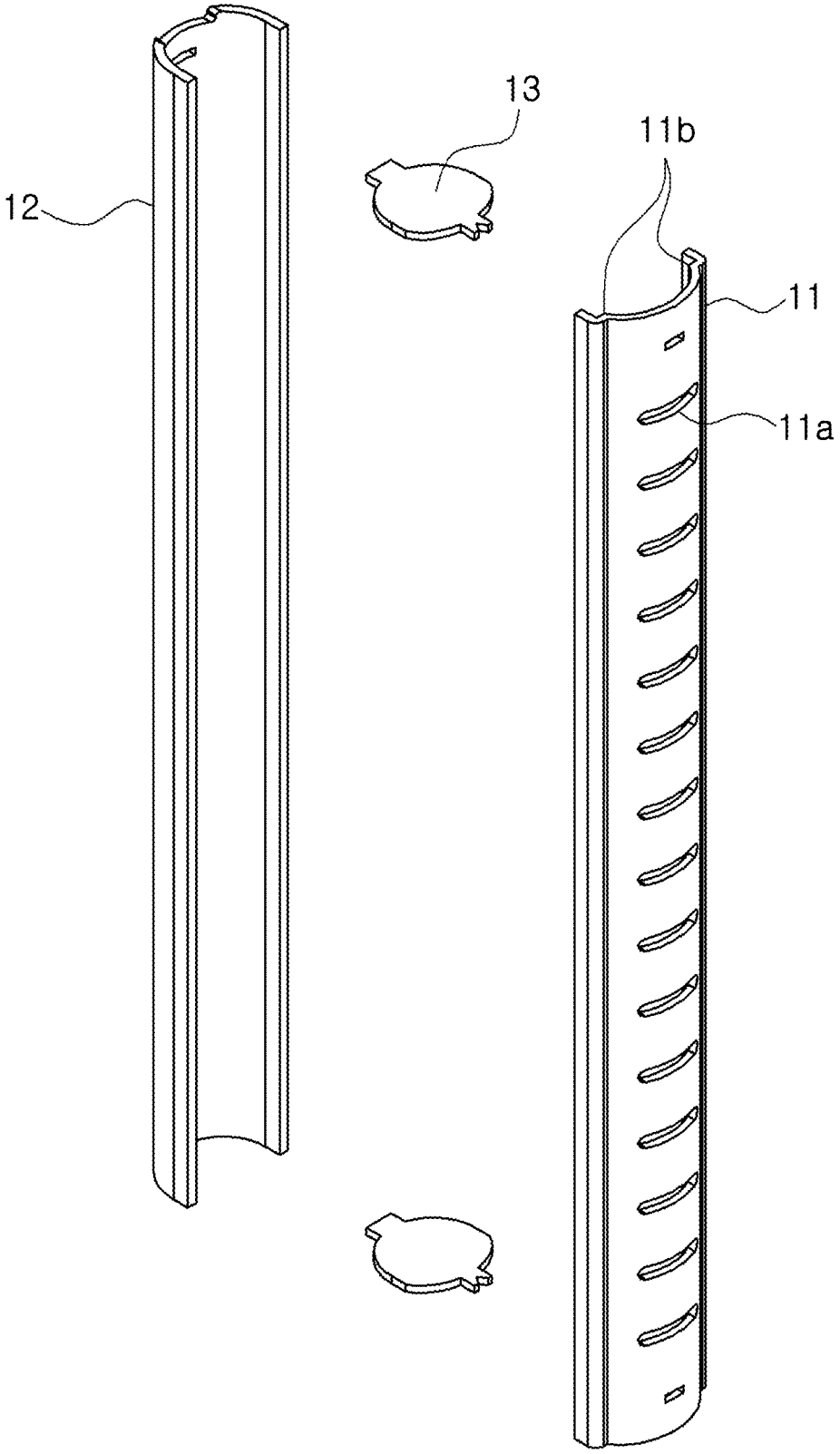
FIG. 2 PRIOR ART
FIG. 2 is an exploded perspective view of a header tank according to the related art.
Figure 3:
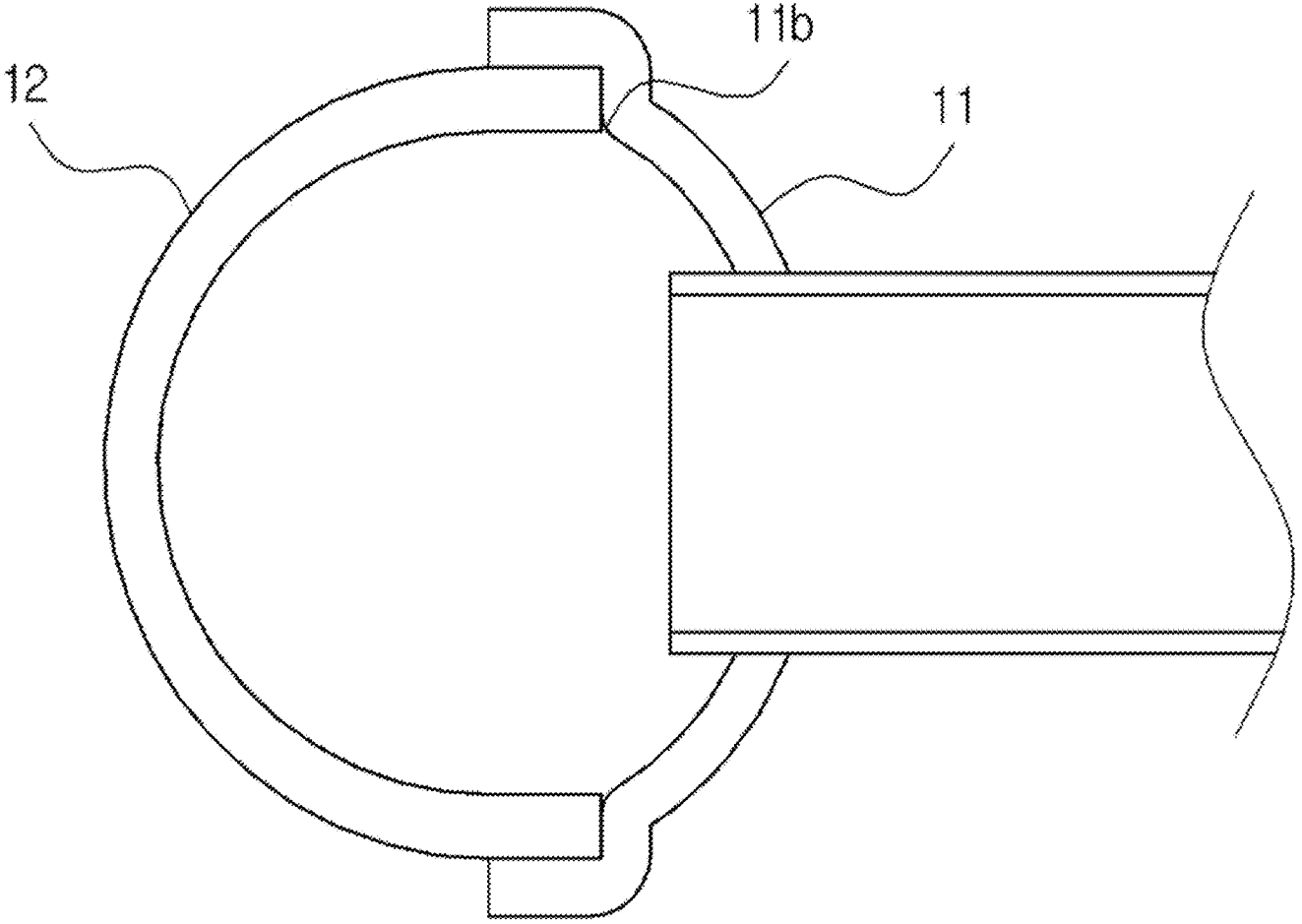
FIG. 3 PRIOR ART
FIG. 3 is a fragmentary schematic cross-sectional view illustrating a heat exchanger and a header tank according to the related art.
Figure 4:
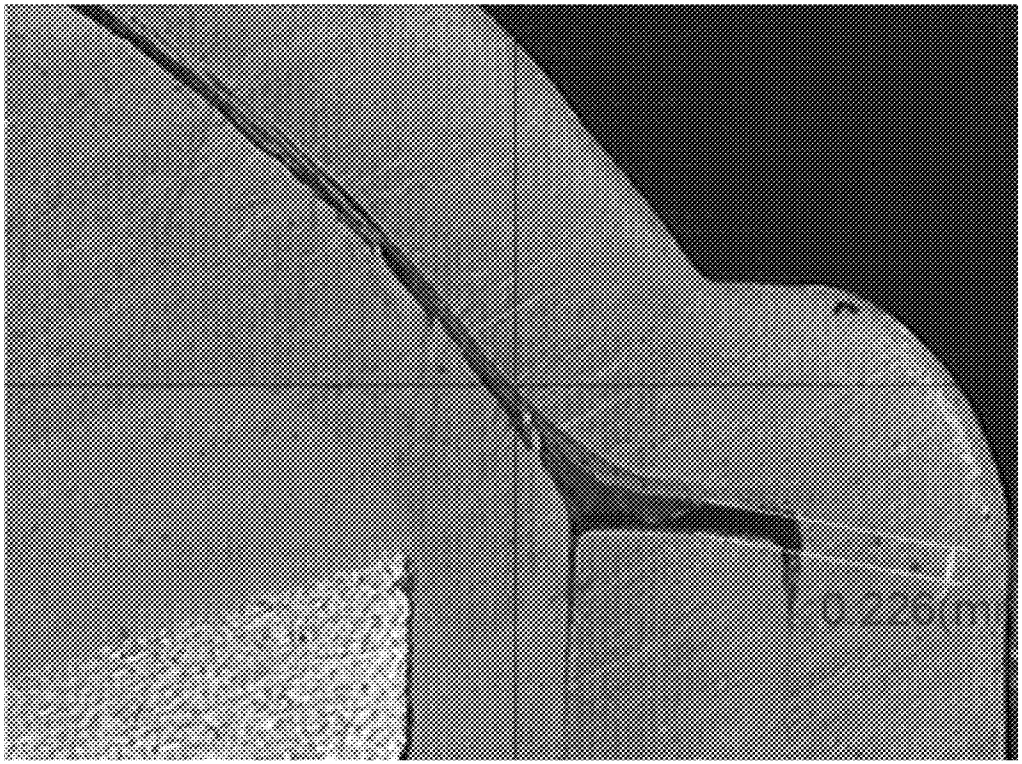
FIG. 4 PRIOR ART
FIG. 4 is a photograph illustrating a portion at which a header, a tank, and a baffle are joined with one another according to the related art.

1000: heat exchanger
100: header tank (of heat exchanger)
200: tank
210: end portion
220: end surface or upper end surface
230: inner side surface
240: outer side surface
250: edge portion
260: tap insertion hole
300: header
310: bending part
311: tube insertion hole
312: tap insertion hole
320: bent part
321: first bent part or horizontal bent part
322: second bent part or vertical bent part
330: forming part
340: edge portion
400: baffle
410: plate
420: protruding tap
500: tube
600: pin
A: upper jig
B: lower jig

DETAILED DESCRIPTION OF EMBODIMENTS OF THE INVENTION

Hereinafter, a header tank of a heat exchanger and a heat exchanger having the same according to the present invention having the configuration as described above will be described in detail with reference to the accompanying drawings. Use of directional references such as upper, lower, horizontal, vertical, and the like, for example, are for reference to orientation of the drawings only and are not meant to limit the invention in any way. The actual directional references may be different from as described herein when oriented for actual assembly, orientation, installation, and use of the inventive structure.

Figure 5:
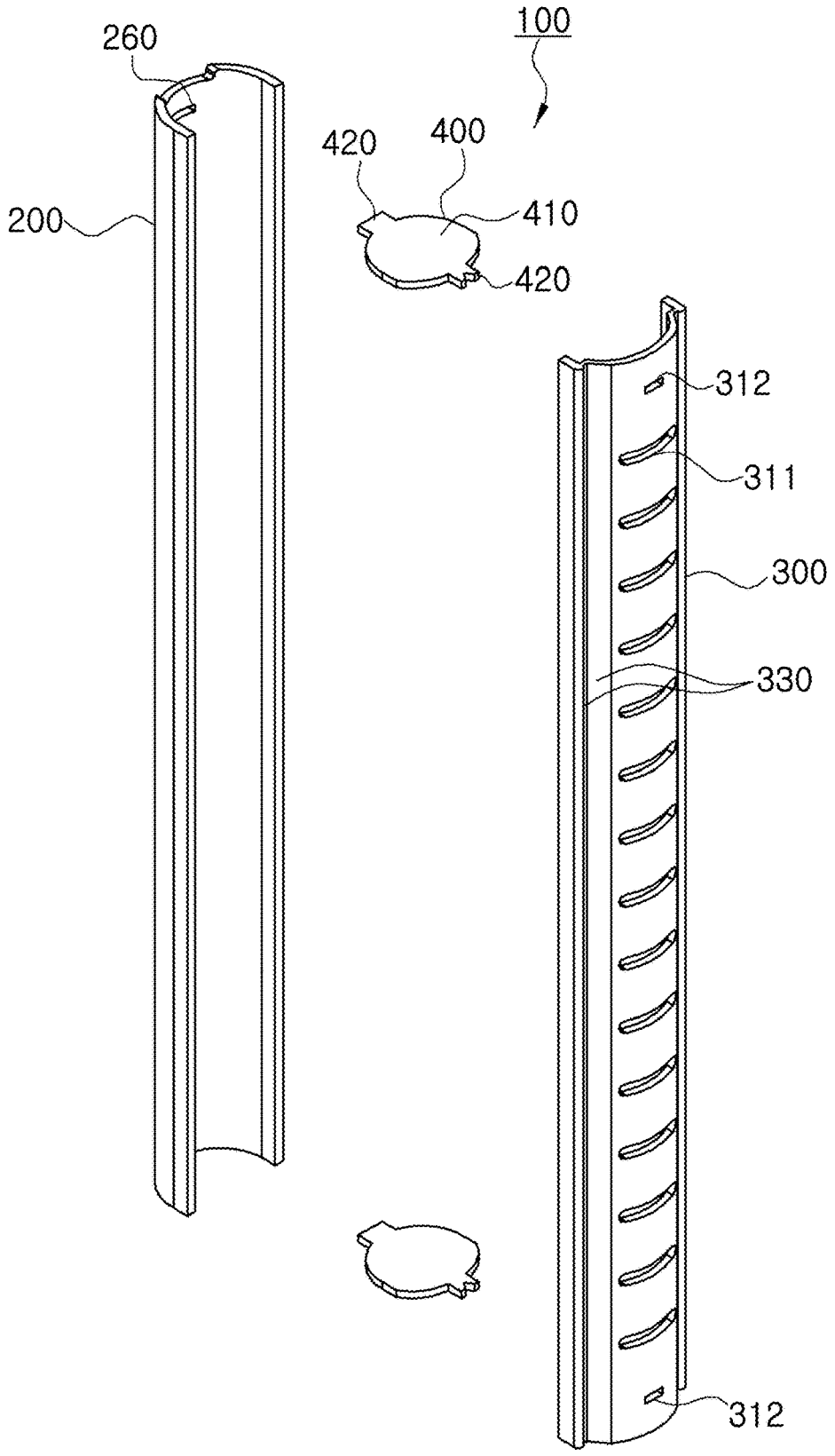
FIG. 5 is an exploded perspective view illustrating a header tank of a heat exchanger according to the present invention.
Figure 6:
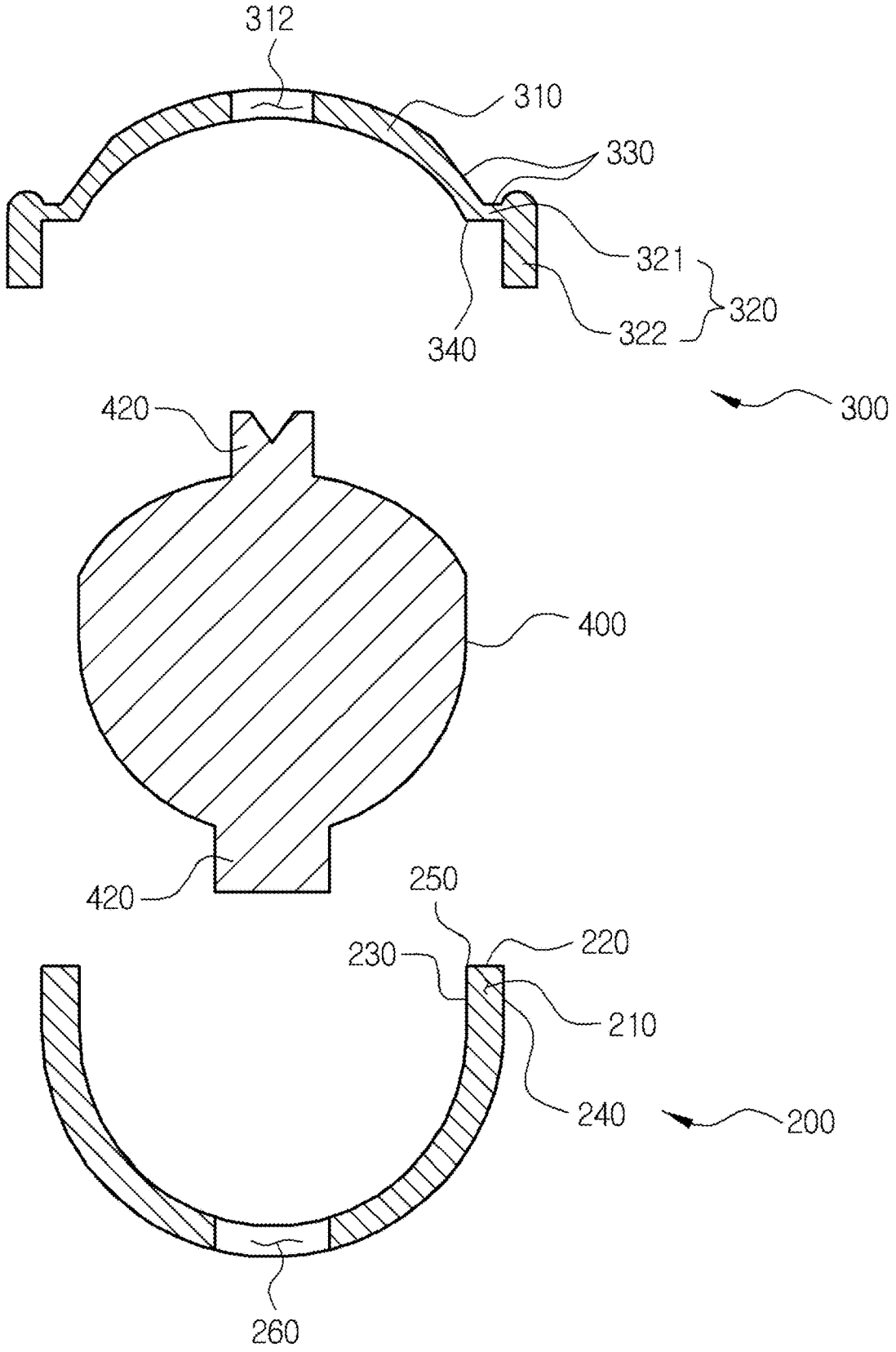
FIG. 6 is an exploded cross-sectional view illustrating the header tank of the heat exchanger according to the present invention.
Figure 7:
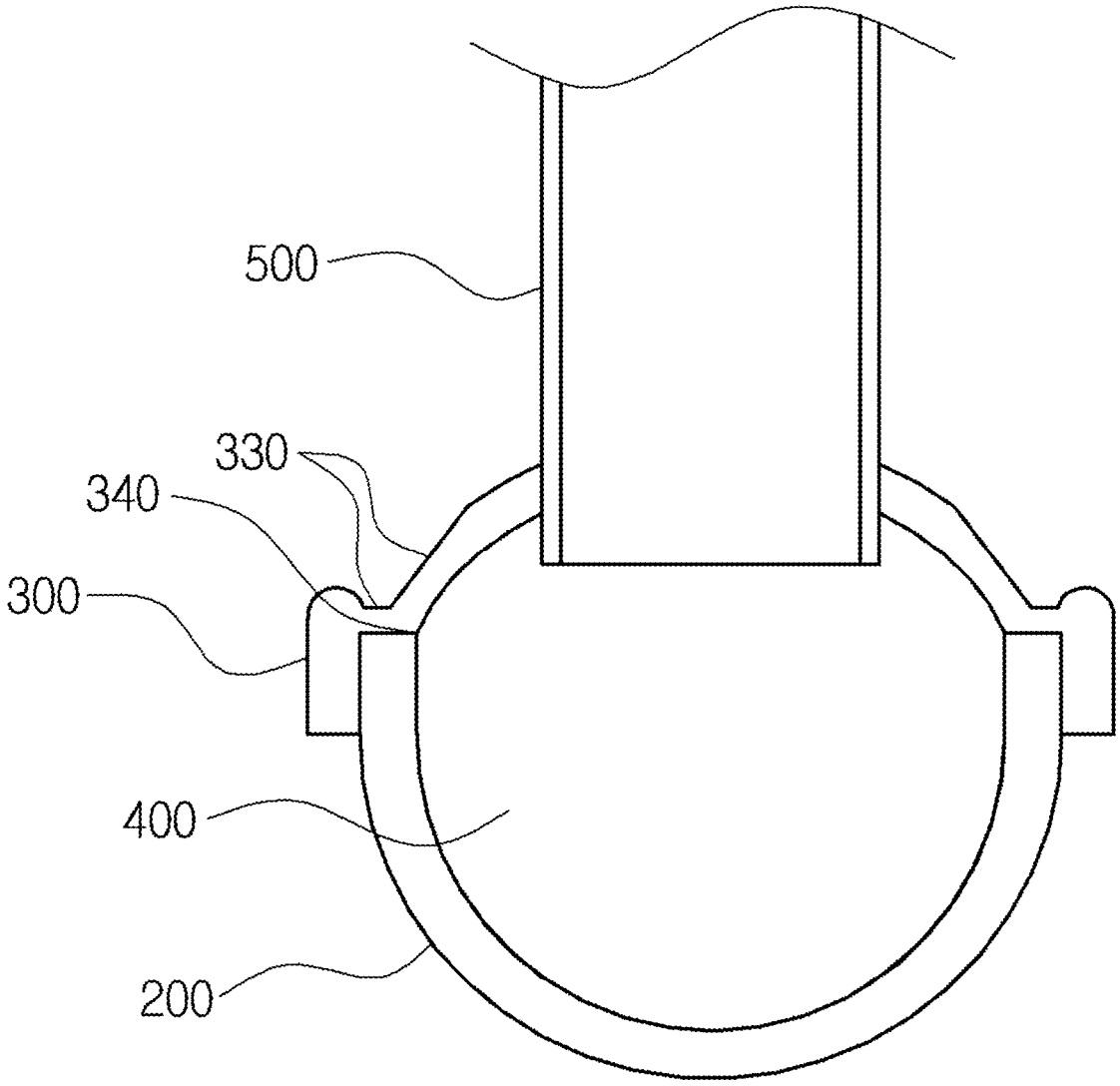
FIG. 7 is a fragmentary schematic cross-sectional view illustrating the header tank and the heat exchanger according to the present invention.
Figure 8:
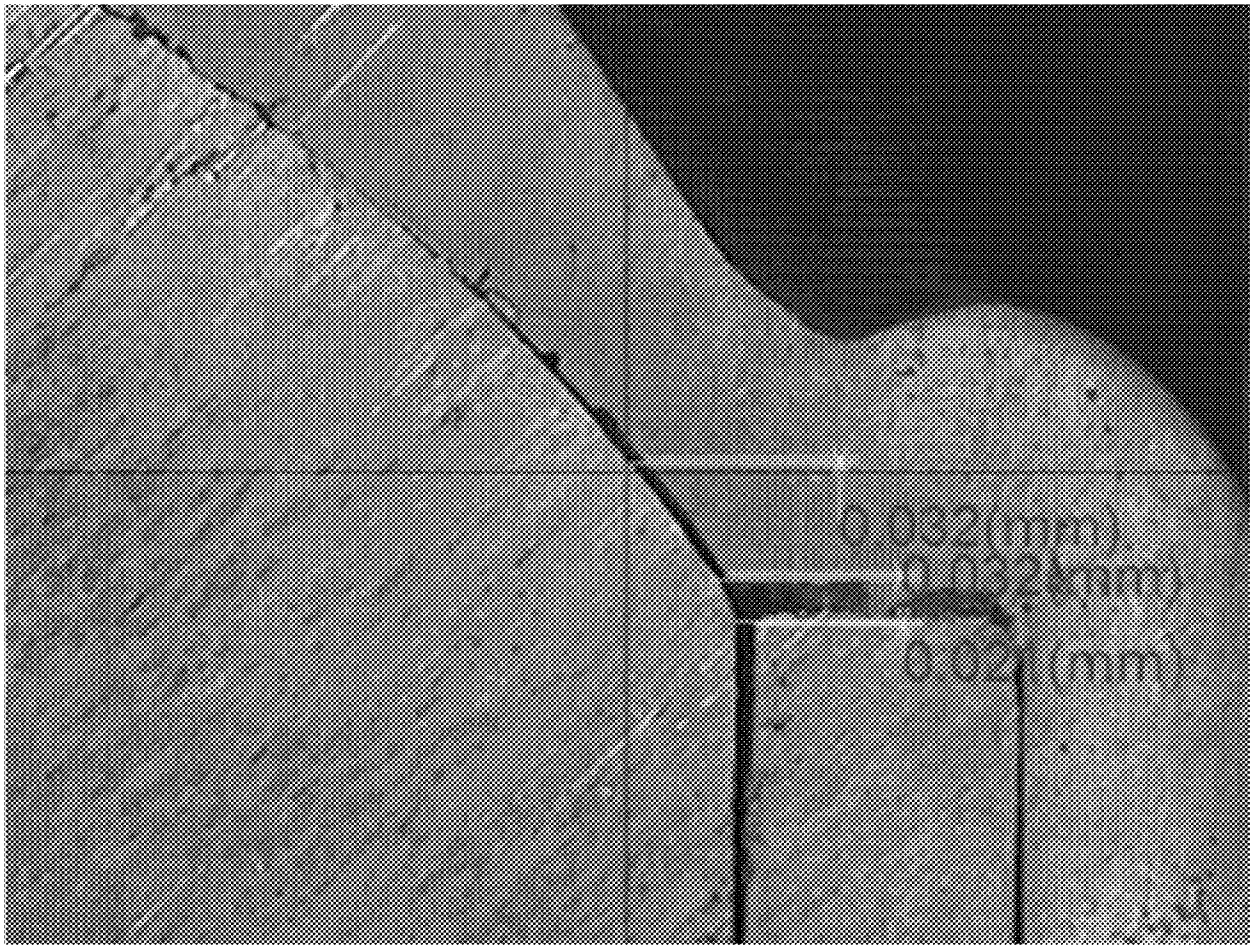
FIG. 8 is a photograph illustrating a portion at which a header, a tank, and a baffle are joined with one another according to the present invention.

FIG. 5 is an exploded perspective view illustrating a header tank of a heat exchanger according to the present invention, FIGS. 6 and 7 are an exploded cross-sectional view and an assembled cross-sectional view illustrating the header tank of the heat exchanger according to the present invention, and FIG. 8 is a photograph illustrating a portion at which a header, a tank, and a baffle are joined with one another according to the present invention.

As illustrated, a header tank 100 of a heat exchanger according to the present invention is configured to include a tank 200 formed to have a hollowed inside and an opened upper side; a header 300 disposed to be in contact with upper end surfaces 220 of both end portions 210 of the tank 200 in a width direction of the tank 200 and coupled to the tank 200; and a baffle 400 interposed between the tank 200 and the header 300 and having an outer circumference surface formed to be in contact with inner circumference surfaces of the tank 200 and the header 300, wherein inner side edge portions 250 and 340 of the tank 200 and the header 300 at which the tank 200 and the header 300 are in contact with may be formed to be in contact with an outer circumference surface of the baffle 400 while not forming a space in portions at which the inner side edge portions 250 and 340 are in contact with the outer circumference surface of the baffle 400.

First, the header tank 100 of the heat exchanger according to the present invention may have a fluid path of a heat exchanging medium formed therein by coupling the tank 200 and the header 300 to each other, and may be formed so that one end or both ends of the header tank 100 are blocked by the baffle 400 interposed between the tank 200 and the header 300, or may be formed so that a flow between both ends of the header tank 100 is blocked by the baffle 400.

Here, the tank 200 may be formed to have a hollowed inside and an opened upper side, and may be formed to be long in a length direction and may be formed in a downwardly concave shape so that both sides in a width direction are directed to an upper side. That is, the tank 200 may be formed in a shape obtained by cutting a pipe in the length direction, may be formed so that a cut and opened portion is directed to the upper side, or may also be formed to have the downwardly concave shape obtained by bending a plate in the width direction. Here, the tank 200 may be formed so that both ends thereof in the length direction are opened.

The header 300 may be formed to have a hollowed inside and an opened lower side, and may be formed to be long in a length direction and may be formed in an upwardly convex shape so that both sides in a width direction are directed to a lower side. That is, the header 300 may be formed in a shape obtained by cutting a pipe in the length direction, may be formed so that a cut and opened portion is directed to the lower side, or may also be formed to have the upwardly convex shape obtained by bending a plate in the width direction. Here, the header 300 may be formed so that both ends thereof in the length direction are opened. Further, the header 300 is coupled to the tank 200, and is disposed to be in contact with the upper end surfaces of both end portions 210 of the tank 200 in the width direction of the tank 200. That is, the header 300 and the tank 200 may be coupled to each other so that both end portions of the header 300 in the width direction of the header 300 are in contact with both end portions of the tank 200 in the width direction of the tank 200, and the header 300 and the tank 200 may be coupled to each other so that lower end surfaces of end portions of the header 300 are in contact with the upper end surfaces 220 of the end portions 210 of the tank 200. As a result, a fluid path through which a heat exchanging medium may flow may be formed by the coupling of the tank 200 and the header 300.

The baffle 400 serves to block the fluid path formed by the coupling of the tank 200 and the header 300, and the baffle 400 is interposed between the tank 200 and the header 300 and is formed so that an outer circumference surface of the baffle 400 is in contact with inner circumference surfaces of the tank 200 and the header 300, thereby making it possible to couple the baffle to the tank 200 and the header 300. In addition, the baffle 400 may be disposed at one end or both ends of the tank 200 and the header 300 to prevent the heat exchanging medium from being leaked to the outside of the header tank 100, or may be disposed between both ends of the tank 200 and the header 300 to prevent the heat exchanging medium from being leaked from the inside of the header tank 100.

Here, the inner side edge portions 250 and 340 of the tank 200 and the header 300 at which the tank 200 and the header 300 are in contact with may be formed to be in contact with the outer circumference surface of the baffle 400 while not forming a space in portions at which the inner side edge portions 250 and 340 are in contact with the outer circumference surface of the baffle 400.

That is, an inner surface 230 formed on the end portion 210 of the tank 200 in the width direction of the tank 200 may be accurately in contact with the baffle 400 so as to correspond to an outer circumference shape of the baffle 400 and be accurately in contact with an outer circumference (an outer circumference surface) of the baffle 400, and the inner side edge portions 250 of the end portions 210 of the tank 200 and the inner side edge portions 340 of the header 300 may be formed to be in contact with each other without being spaced apart from each other. In other words, the inner side edge portions 250 of the end portions 210 of the tank 200 and the inner side edge portions 340 of the header 300 are not rounded, but may be formed in an angled shape.

As a result, in the header tank to which the header and the tank are coupled to form the fluid path of the heat exchanging medium and to which the baffle interposed between the header and the tank and blocking the flow of the heat exchanging medium is coupled, there is an advantage that it is possible to prevent leakage of the heat exchanging medium from the header tank of the heat exchanger after the header, the tank, and the baffle are bonded by the brazing by allowing an edge portion at which the header, the tank, and the baffle are joined together with one another not to be spaced apart from the tank and the baffle.

In addition, after the tank 200, the header 300, and the baffle 400 are assembled, they may be coupled to one another by welding or brazing.

That is, since the edge portion 250 of the tank 200 and the edge portion of the header 300 at which the tank 200, the header 300, and the baffle 400 are joined together with one another are formed in the angled shape, an empty space is not formed. Thereby, since a hole or the empty space is not generated when the tank 200, the header 300, and the baffle 400 are coupled to one another by the welding or the brazing, it is possible to prevent the heat exchanging medium from being leaked from the header tank 100 of the heat exchanger. As a result, since a material molten at the time of welding or brazing may certainly fill a gap of the portion at which the respective members are joined with one another, it is possible to prevent leakage of the heat exchanging medium.

In addition, the header 300 is configured to include a bending part 310 formed to be upwardly convex; and bent parts 320 formed to have horizontal bent parts 321 formed by bending both ends of the bending part 310 in a width direction of the bending part 310 in an outer horizontal direction and vertical bent parts 322 formed to be downwardly bent from the horizontal bent parts 321 to thereby surround the upper end surfaces 220 and an outer side surface 240 of the end portions 210 of the tank 200, wherein the inner side edge portions 340 at which the bending part 310 and the horizontal bent parts 321 are joined with each other may be formed to be in contact with the upper end surfaces 220 of the tank 200 and the outer circumference surface of the baffle 400 while not forming a space in portions at which the inner side edge portions 340 are in contact with the upper end surfaces 220 of the tank 200 and the outer circumference surface of the baffle 400.

This means that both sides of the header 300 in the width direction of the header 300 are formed so that the tank 200 may be easily coupled to the header 300, and is a configuration enabling the header 300 and the tank 200 to be easily coupled to each other by forming the bent parts 320 including the horizontal bent parts 321 and the vertical bent parts 322 at both sides of the header 300 in the width direction of the header 300 to thereby allow the upper end surfaces 220 of the tank 200 to be in contact with the header 300 and allow the outer side surface 240 of the end portions 210 of the tank 200 to be surrounded by the bent parts 320. More particularly, the bending part 310 may be formed so that a center portion of the header 300 in the width direction of the header 300 is upwardly convex, and both ends of the bending part 310 in the width direction of the bending part 310 are horizontally bent to the outer side, such that the horizontal bent parts 321 may be formed to be extended and the vertical bent parts 322 which are downwardly bent from the horizontal bent parts 321 may be formed to be extended. Here, the inner side (lower) edge portions 340 at which the bending part 310 and the horizontal bent parts 321 are joined with each other may be formed to be in contact with the upper end surfaces 220 of the tank 200 and the outer circumference surface of the baffle 400 while not forming a space in portions at which the inner side edge portions 340 are in contact with the upper end surfaces 220 of the tank 200 and the outer circumference surface of the baffle 400.

In addition, the header 300 may have the bending part 310 and the bent parts 320 formed by pressing or bending-machining a sheet of plate.

That is, a sheet of plate having a narrow width and a long length may be formed by blanking a wide plate, and the bending part 310 and the bent parts 320 may be formed by pressing or bending-machining a sheet of plate. Here, the inner side (lower) edge portions 340 at which the bending part 310 and the horizontal bent parts 321 are joined with each other are rounded by characteristics at the time of bending. However, according to the present invention, the edge portions 340 may be formed to be in contact with the upper end surfaces 220 of the tank 200 and the outer circumference surface of the baffle 400 while not forming a space in portions at which the edge portions 340 are in contact with the upper end surfaces 220 of the tank 200 and the outer circumference surface of the baffle 400, by allowing the edge portions 340 not to be rounded. Alternatively, the sheet of plate having the narrow width and the long length may also be machined so that the bending part 310 and the bent parts 320 are formed by a roll forming. Here, the roll forming is a machining method in which a shape of the plate is deformed while the plate passes through rotated rollers which are disposed in multiple stages along a length direction and the plate is gradually manufactured in a desired shape while sequentially passing through the rollers disposed in multiple stages.

In addition, by a forming machining in which upper sides of the end portions of the bending part 310 and upper sides of the horizontal bent parts 321 are pressed by upper jigs A in a state in which the header 300 is supported by lower jigs B so that inner sides of the end portions of the bending part 310 and lower sides of the horizontal bent parts 321 are supported, the edge portions 340 of the header 300 may be formed to be in contact with the tank 200 and the baffle 400 while not forming a space in portions at which the edge portions 340 are joined with the tank 200 and the baffle 400.

Figure 9:
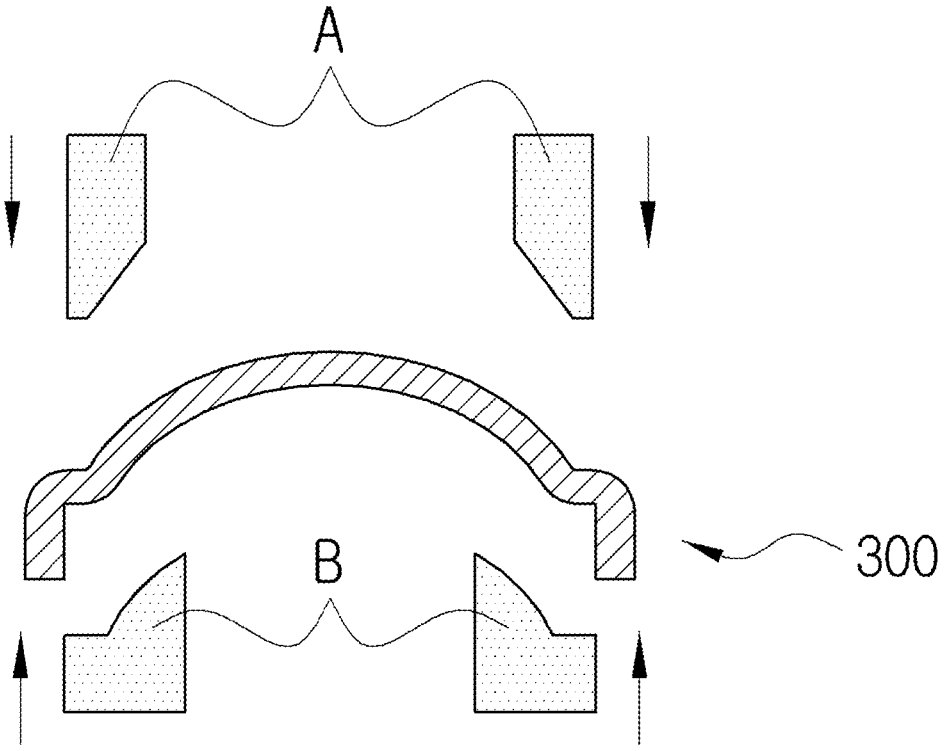
FIGS. 9 and 10 are schematic views illustrating a process of forming a forming part in a header using a jig according to the present invention.
Figure 10:
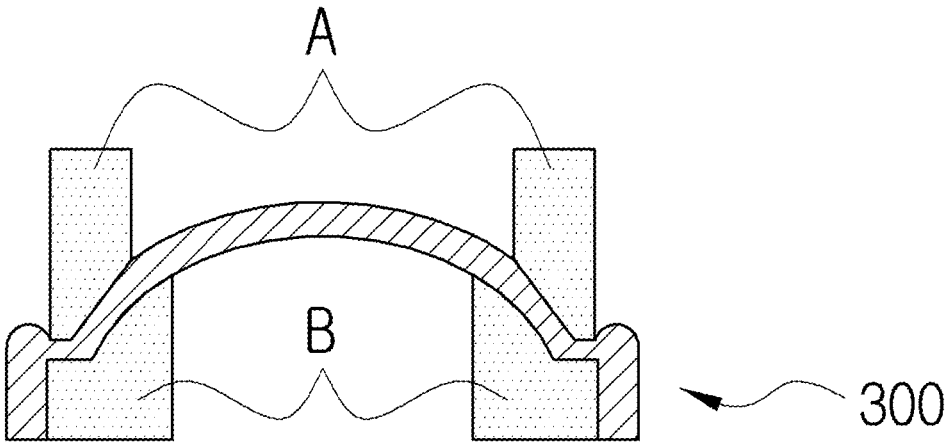

That is, if the horizontal bent parts 321 are formed to be extended by bending the end portions of the bending part 310 in the width direction of the bending part 310 in the outer horizontal direction, the edge portions 340 may be rounded as described above. Therefore, the edge portions 340 may be formed in the angled shape by the forming machining in which after the portions at which the bending part 310 and the horizontal bent parts 321 are joined with each other are supported by the lower jigs B, the portions at which the bending part 310 and the horizontal bent parts 321 are joined with each other are downwardly pressed using the upper jigs A so that forming parts 330 having a concave shape are formed at the upper sides of the end portions of the bending part 310 and the upper sides of the horizontal bent parts 321, as illustrated in FIGS. 9 and 10. In other words, as illustrated in FIG. 9, the header 300 before the forming machining has the edge portions 340 which were rounded by the bending machining, or the like. However, the edge portions 340 are deformed in an edge shape formed on upper surfaces of the lower jigs B by the forming machining as illustrated in FIG. 10 while surroundings including the edge portions 340 are pressed by the jigs, thereby making it possible to form the edge portions 340 of the header 300 in the angled shape.

As a result, the edge portions 340 of the header 300 may be formed to be in contact with the upper end surfaces 220 of the tank 200 and the outer circumference surface of the baffle 400 while not forming a space in portions at which the edge portions 340 of the header 300 are in contact with the upper end surfaces 220 of the tank 200 and the outer circumference surface of the baffle 400.

In addition, a portion of the bending part 310 and a portion of the horizontal bent parts 321 which are formed at both sides in relation to the edge portions 340 of the header 300 may be formed as forming parts 330 formed by pressing the portion of the bending part 310 and the portion of the horizontal bent parts 321 by the forming machining, and the forming parts 330 may be formed to have a thickness thinner than that of the remaining portions of the header 300.

That is, the thickness of surroundings including the edge portions 340 of the header 300 may be generally formed to be almost identical to the remaining portions before the forming machining. As a result, the forming parts 330 formed by pressing the header 300 by the jigs at the time of forming machining may be formed to have a thickness thinner than that of the remaining portions of the header 300.

In addition, the baffle 400 may have one or more protruding taps 420 formed to be extended from a circumference of a plate 410 formed in a disk shape, and tap insertion holes 260 and 312 may be formed in any one or more of the tank 200 and the header 300 so that the protruding taps 420 of the baffle 400 are inserted into and coupled to the tap insertion holes 260 and 312.

As an example, as illustrated, the protruding taps 420 are formed to be extended from both sides of the baffle 400, the insertion holes 260 are formed in the tank 200, and the insertion holes 312 are formed in the header 300, thereby making it possible to insert and couple the protruding taps 420 into the insertion holes 260 and 312. As a result, it is possible to prevent the baffle from being rotated before being welded or brazed in a state in which the baffle 400 is interposed and assembled between the tank 200 and the header 300. Accordingly, contact surfaces of the header and the baffle are not spaced apart from each other and contact surfaces of the tank and the baffle are not spaced apart from each other, thereby making it possible to prevent the heat exchanging medium from being leaked from bonded portions between the header, the tank, and the baffle.

Figure 11:
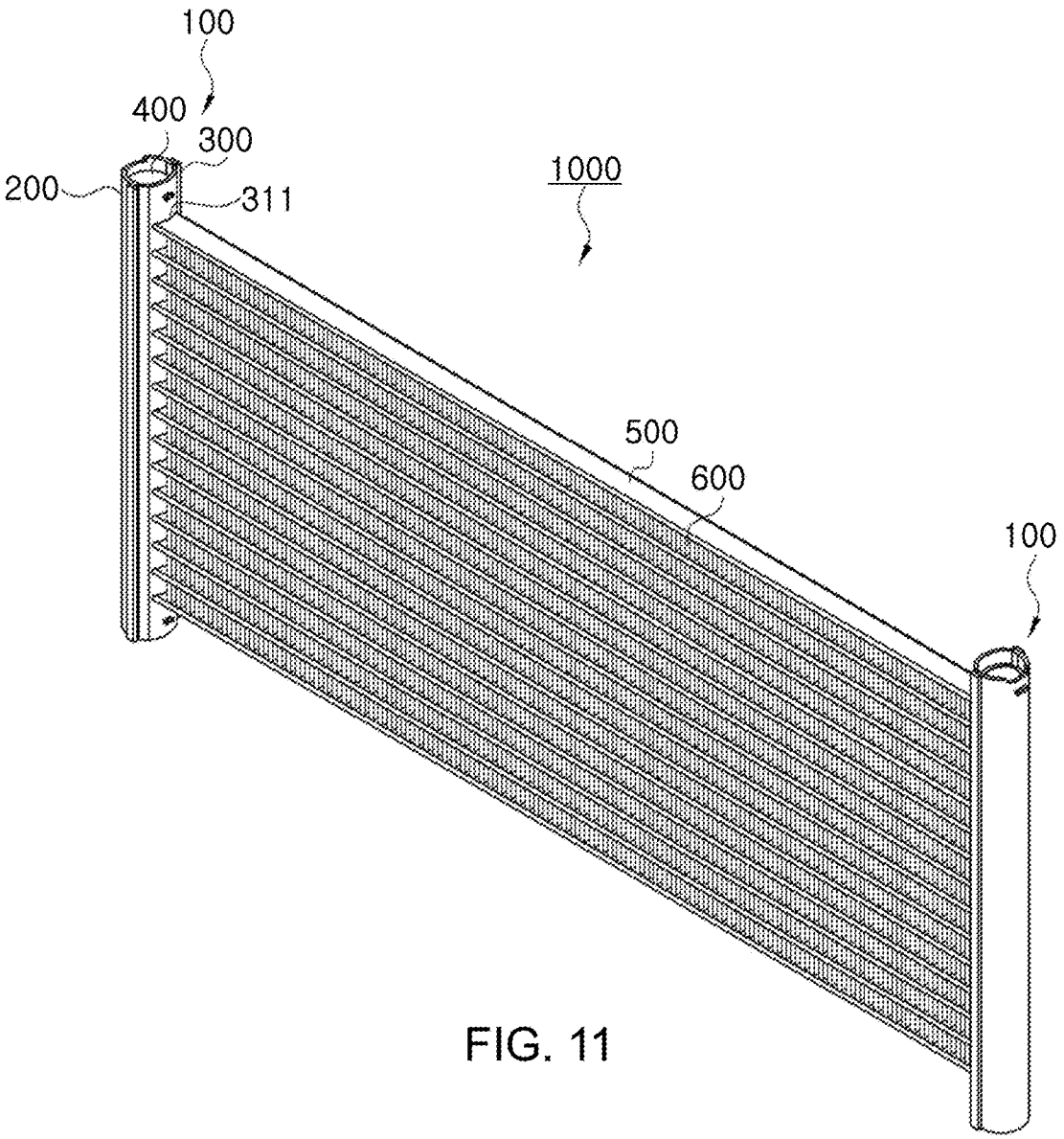
FIG. 11 is an assembled perspective view illustrating a heat exchanger according to the present invention.

In addition, a heat exchanger 1000 according to the present invention having the header tank 100 of the heat exchanger formed as described above may be configured to include the header tanks 100 of the heat exchanger formed to be spaced apart from each other by a predetermined distance and be in a line; a plurality of tubes 500 having both ends connected to the header tanks 100; and pins 600 interposed between the tubes 500, as illustrated in FIG. 11.

Here, a tube insertion hole 311 may be formed in the header 300 in a width direction, and a plurality of tube insertion holes 311 may be formed to be spaced apart from each other in a length direction of the header and be in a line. As a result, after end portions of the tubes 500 are inserted into and coupled to the tube insertion holes 311 of the header, the brazing is performed, thereby making it possible to fix the tubes 500 to the header tank 100.

According to the exemplary embodiment of the present invention, in the header tank of the heat exchanger and the heat exchanger having the same, a gap (space) of a portion at which the header, the tank, and the baffle are joined with one another is minimized, thereby making it possible to prevent the leakage of the heat exchanging medium from the header tank after the header, the tank, and baffle are bonded to one another by the brazing.

The present invention is not limited to the above-mentioned embodiments but may be variously applied, and may be variously modified by those skilled in the art to which the present invention pertains without departing from the gist of the present invention claimed in the claims.

What is claimed is:

1. A header tank of a heat exchanger, the header tank comprising:

a tank having a hollow open side;

a header contacting end surfaces of end portions of the tank; and a baffle interposed in a space formed between the tank and the header, an outer surface of the baffle contacting an inner surface of the tank and an inner surface of the header and no space is formed between the baffle and the header and the tank, the baffle coupled to the header and the tank, wherein the baffle is coupled to the header and the tank by welding or brazing wherein no space is formed at a portion where the header, the tank, and the baffle are joined together with one another, wherein the header includes a bending part formed as convex with respect to the end surfaces of the end portions of the tank, wherein the header includes a pair of first bent parts formed by bending both ends of the bending part in a width direction of the bending part in an outer horizontal direction, wherein an inner side edge portion is formed at the inner surface of the header at a portion of the header joining the bending part with each of the first bent parts, wherein each of the inner side edge portions is formed in an angled shape, wherein a forming part having a concave shape with respect to an outer surface of the header is formed in the outer surface of the header in each of the first bent parts and a portion of the bending part adjacent each of the first bent parts, wherein each of the forming parts has a thickness less than a thickness of the bending part at a portion of the bending part not including the forming part, wherein the header further comprises a pair of second bent parts with each of the second bent parts extending from one of the first bent parts in a direction different from a direction of extension of the first bent parts, wherein a portion of each of the first bent parts is pressed to be formed thinner than the second bent part, wherein a convex portion is formed in the outer surface of the header at each of the first bent parts adjacent an outer side of the forming part, the convex portion convex with respect to the outer surface of the header, and wherein the convex portion protrudes in a direction opposite to a direction in which the portion of each of the first bent parts is pressed, and wherein the direction in which the portion of each of the first bent parts is pressed is the same as a direction in which the tank is inserted into the header when coupling the tank to the header, wherein the forming part is indented to be formed thinner relative to each of an extension of an outer curved surface of the bending part and an upper end of the convex portion.

2. The header tank of claim 1, wherein the first bent parts and the second bent parts cooperate to surround the end surfaces of the end portions of the tank.

3. The header tank of claim 1, wherein the first bent parts abut the end surfaces of the end portions of the tank.

4. The header tank of claim 1, wherein the second bent parts extend perpendicular to the first bent parts.

5. The header tank of claim 1, wherein the bending part, the first bent parts, and the second bent parts of the header are formed by pressing, bending, or machining a sheet or plate.

6. The header tank of claim 1, wherein the baffle includes a plurality of taps extending radially outwardly from a circumferential edge configured to be received in holes formed in at least one of the tank and the header.

7. The header tank of claim 1, wherein the header tank is configured to receive a plurality of heat exchanger tubes of the heat exchanger for conveying a heat exchanger fluid therein.

8. The header tank of claim 1, wherein the no space is formed at an intersection of edge portions of the end surfaces of the end portions of the tank, the edge portions of the header, and the baffle.

9. The header tank of claim 1, wherein the header is formed using first jigs and second jigs, wherein each portion of the inner surface of the header corresponding to one of the inner side edge portions is supported by one of the first jigs while each portion of the outer surface of the header corresponding to one of the forming parts is pressed by one of the second jigs towards a corresponding one of the first jigs.

10. The header tank of claim 9, wherein the first jigs form the angled shape in each of the inner side edge portions while the second jigs form the concave shape in each of the forming parts.

11. The header tank of claim 1, wherein an outer side edge is formed at the outer surface of the header where the bending part meets each of the forming parts with each of the outer side edges being formed in an angled and convex shape.

12. The header tank of claim 1, wherein each of the convex portions is disposed to protrude coaxially with the adjacent one of the second bent parts.

* * * * *